US006154914A

United States Patent [19]

Suzuki et al.

[11] Patent Number: 6,154,914

[45] Date of Patent: Dec. 5, 2000

[54] COSMETIC APPLICATOR AND PROCESS FOR PRODUCING THE SAME

[75] Inventors: Akio Suzuki; Takeshi Yamazaki, both of Tokyo, Japan

[73] Assignee: Tokyo Puff Co., Ltd., Tokyo, Japan

[21] Appl. No.: 09/079,870

[22] Filed: May 15, 1998

[30] Foreign Application Priority Data

May 19, 1997 [JP] Japan ..... 9-128438

[51] Int. Cl.[7] ..... A45D 33/34

[52] U.S. Cl. ..... 15/229.14; 15/209.1; 132/320; 132/317; 132/293

[58] Field of Search ..... 15/244.3, 229.14, 15/244.4, 244.1, 209.1, 210.1; 132/320, 293, 317

[56] References Cited

U.S. PATENT DOCUMENTS 2,509,266 5/1950 Epstein et al. .

5,771,524 6/1998 Woods et al. .

*Primary Examiner*—Timothy M. Speer
*Assistant Examiner*—Jennifer McNeil
*Attorney, Agent, or Firm*—Oppedahl & Larson LLP

[57] ABSTRACT

A cosmetic applicator and a process for producing the same are disclosed. The cosmetic applicator according to the present invention comprises a pair of components each comprising a cloth material used for coating cosmetics and a core material which is wrapped with the cloth material from the front surface side to the back surface side of the core material, and a welding sheet arranged at a joining portion of the two components which are arranged to face the respective back surfaces in order to join the back surfaces of the two components with each other, wherein the cloth material at the back surface side of the core material is folded at a predetermined size in the site excluding the central portion of the core material to form a folding face, and an excess endface inside the peripheral edge of the folding face is subjected to drawing.

6 Claims, 1 Drawing Sheet

COSMETIC APPLICATOR AND PROCESS FOR PRODUCING THE SAME

BACKGROUND OF THE INVENTION

1. Field of the Invention

The present invention relates to a cosmetic applicator used for coating cosmetics and a process for producing the same.

2. Description of the Related Art

A cosmetic applicator such as a powder puff is generally used by directly patting it against the skin of a user. Therefore, it is required for the cosmetic applicator to passes qualities such as elasticity or washing resistance while retaining a delicate feeling for example feeling smooth or soft to the skin.

The conventional cosmetic applicator of this type is a cosmetic applicator comprising two components: a coating cloth material and a sponge core material wrapped in the coating cloth material. The components are joined, with their back surfaces facing each other. In order to obtain the above-described qualities, the conventional cosmetic applicator is produced by sewing. This sewing is a manual process with a sewing machine and therefore its working efficiency is poor. Further, since a skilled worker is required, the conventional cosmetic applicator has had the problems in recruiting skilled workers and also in production cost. In addition, there has been the problem that an unexpected accident may, occur such as inclusion of a broken needle of a sewing machine.

Recently, many attempts are made to produce a cosmetic applicator by adhering the components together using various adhesives in order to solve those problems. In one, process the back surfaces of two components are joined by coating a hot-melt type adhesive on the entire region of the back surfaces, and heating the same, thereby fixedly adhering the core material and the cloth material. The adhesive is cured by heating, and it is difficult to secure the above-described delicate feeling which is required for a cosmetic applicator. In processes of coating a un-heated adhesive, it is difficult to control the amount of an adhesive applied. The amount of adhesive applied be insufficient may or the amount of adhesive may be too large, with the result that adhesive leaks out from the adhered part. Thus, there is the problem that deviation in every product is large, and softness required for an applicator and a beautiful appearance required for cosmetic accessories are impaired. Further, cosmetic applicators produced by a process using any one of those adhesion works have the problem that the core material deviates from a central portion of the product in washing the applicator and is localized inside the cloth material, then the product become inconvenient in use.

SUMMARY OF THE INVENTION

The present invention has been made to overcome the above-described disadvantages encountered in the prior art, and therefore, an object of the present invention is to provide a cosmetic applicator which is produced with improved productivity by an adhesion work but has a quality substantially equal to that produced by sewing.

Another object of the present invention is to provide a process for producing the cosmetic applicator, which improves productivity such as workability or production cost.

It has been found by the present inventors that the above-described problems can be overcome by using in production of a cosmetic applicator, in place of the conventional adhesive, a welding sheet having a predetermined shape which can be welded from the outside using a press adhering method by a inductive heating such as high frequency induction, and directly contacting this welding sheet with a core material and a cloth material in a pair of components which constitute the cosmetic applicator. The present invention has been completed based on this finding.

According to the present invention, the process for producing a cosmetic applicator comprising a surface coating portion used for coating cosmetics and a plate-like elastic core material which is located inside the coating portion and forms a core of the entire applicator comprises the steps of: placing the core material on a central portion of a back surface of the cloth material which constitutes the coating portion; wrapping a peripheral portion of the core material placed by the above step in the cloth material; subjecting a folded excess endface of the cloth material to drawing; and interposing a welding sheet between a pair of two components obtained by the above two steps along the draw-worked region and a region excluding the central portion of the core material, and melting the welding sheet site from the outside using a press adhering method by inductive heating such as high frequency induction, thereby integrally joining the pair of the components.

By this process, curing the adhesive and product by heating can be avoided so that the tactile characteristics of the product are not impaired, and it is also not necessary to control the amount of adhesive applied.

The cosmetic applicator according to the present invention is a cosmetic applicator produced by the above process of the present invention. Therefore, the cosmetic applicator has a quality comparable to that of the conventional product by sewing work, and the productivity is markedly improved as compared with the conventional products by sewing work and adhering work.

Further, the cosmetic applicator according to the present invention comprises a pair of components each comprising a cloth material usable for coating cosmetics and a core material which is wrapped with the cloth material from the front surface side to the back surface side of the core material, and a welding sheet arranged at a joining portion of the two components which are arranged to face the respective back surfaces in order to join the back surfaces of the two components with each other, wherein the cloth material at the back surface side of the core material is folded at a predetermined size in the site excluding the central portion of the core material to form a folding face, and an excess endface inside the peripheral edge of the folding face is subjected to drawing.

This cosmetic applicator does not have the problem due to application of an adhesive, and has advantages of high quality and high productivity.

Further objects, characteristics and advantages of the present invention will be apparent from the description herein below.

DETAILED DESCRIPTION OF PREFERRED EMBODIMENT

The present invention will be described in detail below by referring to the embodiment for exemplifying the cosmetic applicator according to the present invention.

Figure 1:
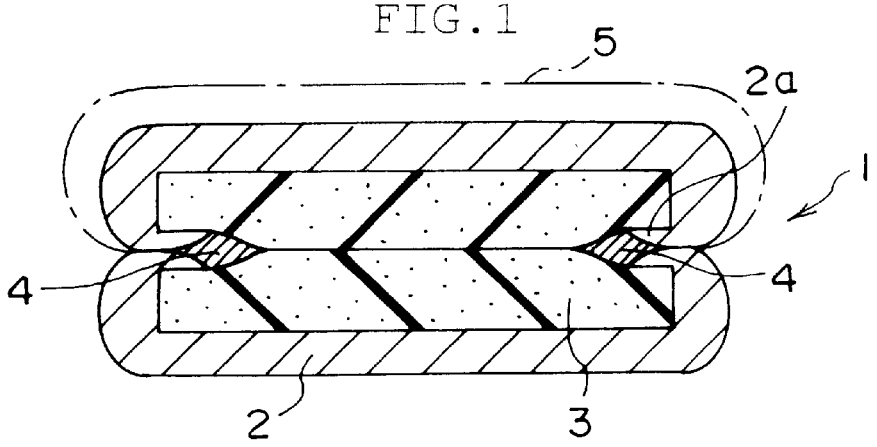
FIG. 1 is a cross sectional view showing one embodiment of the cosmetic applicator according to the present invention.

FIG. 1 shows a cross sectional view of a cosmetic applicator 1 used as a powder puff. In FIG. 1, a cloth material 2 for coating a cosmetic powder, which constitutes the cosmetic applicator 1 is folded toward the back surface side so as to wrap a periphery of a plate-like elastic core material 3 such as a sponge from the front surface side to the back surface side of the core material, thereby forming a folding face 2*a*. A length of the folding face 2*a* is set in a predetermined size such that it forms an area covering from ⅓ to ½ of the back surface of the cosmetic applicator 1 and excluding the central portion of the core material 3. Those two components thus formed are combined as a pair of the upper and lower components, thereby constituting the cosmetic applicator 1. In this embodiment, a pair of the components of the cosmetic applicator 1 are joined with each other with a welding sheet 4 at an area capable of adhering the components to each other with a practically sufficient strength from the excess endface in the cut edge of the cloth material 2 to the core material 3.

A ribbon 5 for holding the applicator in fingers, which has an appropriate length from the joining face of one edge to the joining face of the other edge, is provided so as to use the cosmetic applicator by inserting fingers in a space existing between the cloth material 2 and the ribbon 5 if necessary.

Materials used for the cloth material 2 are pile cloth, cotton, nylon, polyester, acrylic resin and the like. Constituent material of the core material 3 is an elastic material such as polyurethane and the like.

Figure 2:
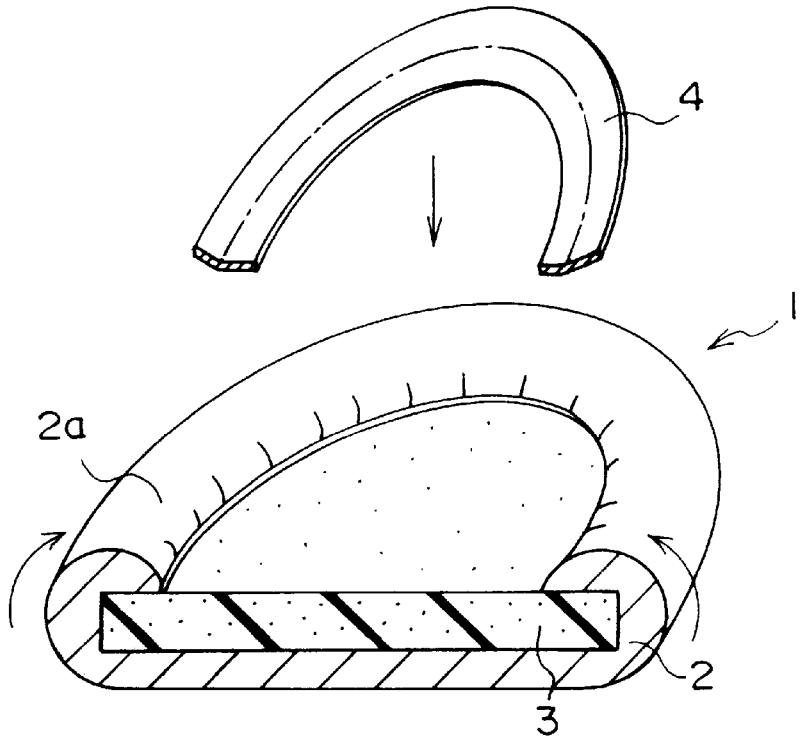
FIG. 2 is an exploded perspective view showing the main portion in one embodiment of the cosmetic applicator according to the present invention.
Figure 3:
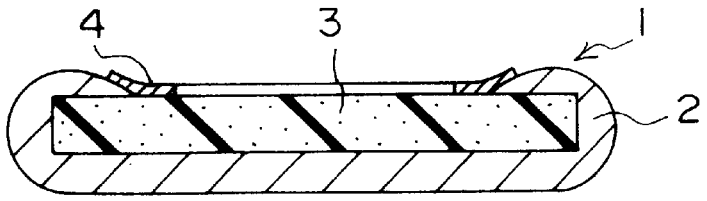
FIG. 3 is a cross sectional view showing the main portion in one embodiment of the cosmetic applicator according to the present invention.

A process for producing the cosmetic applicators 1 thus constituted will be explained below by referring to FIG. 2 and FIG. 3. FIG. 2 shows an exploded perspective view of the main portion of the cosmetic applicator 1, and FIG. 3 is a cross sectional view of the main portion of the cosmetic applicator 1.

The cloth material 2 is cut in a predetermined shape having an area larger than that of the plate-like elastic core material 3 so as to include material to form the folding face 2*a*.

The cloth material 2 wraps the core material 3 from the front surface side to the back surface side of the core material, and at the same time, the excess endface of the cloth material 2 is folded into the back surface side of the core material 3 to form the folding face 2*a*. The vicinity of the cut edge of the folding face 2*a* is subjected to drawing using a press machine. (See FIG. 2).

The welding sheet 4 is cut to have a width from the excess endface of the cut edge of the cloth material 2 to the core material 3, that is, a size of an area extending to the site subjected to drawing inside the peripheral edge of the folding face 2*a*, and also an apparent edge of the peripheral face excluding the central portion of the back surface of the core material 3. In this embodiment, a bottom, i.e. back surface, shape of the product is circular. Therefore, the welding sheet is formed as a doughnut-like sheet form. The welding sheet 4 is not limited to a doughnut-like ring form, but of course can be formed into the desired shape other than the above, such as a square shape or a rectangular shape.

The welding sheet 4 thus formed into a predetermined shape is placed on one component of the cosmetic applicator 1, another component is placed on the welding sheet, with the back surfaces, and the resulting assembly is compressed to adhere two components through the welding sheet.

The compression can be applied at only the site of the welding sheet 4 using a method that does not involve thermal heating, such as compression method by, for example, induction heating or high frequency. Therefore, the welding sheet 4, which can be used in the present invention, is not particularly limited so long as it can be melted in compression without external heating. In this embodiment, a material such as an ethylene polymer is generally used.

As described above, this embodiment is that in placing the welding sheet 4 having a predetermined shape on one of a pair of the components constituting the cosmetic applicator 1, and adhering another component to the one component through the welding sheet, with facing the back surfaces with each other, an area of contacting those components and the welding sheet 4 is only the site subjected to drawing, inside the peripheral edge of the folding face 2a of the cloth material 2, and an area extending to the apparent edge of the peripheral face excluding the central portion of the core material 3. More specifically, the contact shape in this embodiment is a doughnut-like shape as shown in FIGS. 2 and 3. Therefore, in this embodiment, an adhesive is not coated on the central portion of the core material 3, and compression is applied only to the site on which the welding sheet 4 is present. Further, since the present invention uses a compression method by inductive heating, such as compression method by induction heating or high frequency, an external thermal heating is not needed in producing the cosmetic applicator 1. From those facts, in this embodiment many factors are eliminated which may give any influence to the materials of the cloth material 2 and the core material 3 and bring about deformation or modification of the material, which is the problem in producing the conventional cosmetic applicator using an adhesive. Further, no influence is given to the materials of the cloth material 2 and the core material 3 at the site other than the compression site, and also there is substantially no influence to the material even at the compression site.

As a result, according to this embodiment, there is no disadvantage that an adhesive is cured and such adversely affects a delicate use feeling as the cosmetic applicator 1, and a delicate use feeling such as soft tactile feel comparable to that of a cosmetic applicator produced by sewing can be secured. Further, since the two components are tightly adhered at the folding face 2*a* of the cloth material 2 and the peripheral portion of the core material 3, elasticity and quality such as washing resistance can be secured. As a matter of course, there is no possibility that an unexpected accident occurs such that a broken needle of a sewing machine is contained in an applicator as in the case of producing the applicator by sewing work.

Further, in this embodiment, the welding sheet 4 is formed into a desired plate-like shape such as a doughnut-like shape, and supply of members for adhesion can be conducted by merely placing this sheet at a predetermined position. Therefore, there is the possibility that the required amount of an adhesive material lacks or, in contract, the amount of the adhesive coated is too large so as to flow out the adhesive material from the adhered face, as in the embodiment of coating an adhesive. Thus, productivity such as yield of gain, production cost or workability can be improved.

While the present invention has been described in detail and with reference to specific examples thereof, it will be apparent to one skilled in the art that various changes and modifications can be made therein without departing from the spirit and scope of the present invention.

What is claimed is:

1. A process of producing a cosmetic applicator comprising a surface coating portion formed from a cloth material and an elastic core which is located inside the coating portion and forms a core of the applicator, comprising the steps of:

(a) forming a pair of applicator components, each applicator component being formed by the steps of:

placing the core material on a central portion of a back surface of a piece of the cloth material, said piece of the cloth material being in larger in size than the core material whereby an edge portion of the piece of cloth material extends beyond the core material;

wrapping a peripheral portion of the core material in the cloth material;

making a draw-worked region by subjecting the edge portion of the cloth material to drawing; and (b) interposing a welding sheet between the pair of components along the draw-worked region and an adjacent region of the core material excluding the central portion of the core material, and melting the welding sheet from the outside using a press adhering induction heating method by thereby integrally joining the pair of the components to form a cosmetic applicator.

2. The process for producing a cosmetic applicator as claimed in claim 1, wherein the welding sheet is formed into a sheet form so as to adapt to the shape of the cosmetic applicator, wherein the central portion thereof is hollowed.

3. A cosmetic applicator produced by the process as claimed in claim 2.

4. A cosmetic applicator produced by the process as claimed in claim 1.

5. A cosmetic applicator comprising a pair of components each comprising a plate-like core material having a front surface and a back surface and a cloth material, said cloth material being wrapped around the core material to cover the front surface and a portion of the back surface of the core material, and a welding sheet disposed between the two components which are arranged such that their respective back surfaces face one another and joining the back surface of the two components with each other, wherein the cloth material is greater in size than the core material and is drawn into a wrapped position, whereby it extends around the edges of the core material to cover a peripheral portion of the back surface of the core material while leaving a central portion of back surface of the core material exposed; and wherein the welding sheet has been heated by inductive heating to bond the two components together.

6. The cosmetic applicator as claimed in claim 5, wherein the welding sheet is formed into a sheet form so as to adapt to the shape of the cosmetic applicator, wherein the central portion thereof is hollowed.

* * * * *